US006340091B1

(12) United States Patent
Romeo et al.

(10) Patent No.: US 6,340,091 B1
(45) Date of Patent: Jan. 22, 2002

(54) PRODUCT DISPLAY AND DISPENSING RACK

(75) Inventors: Derek Joseph Romeo, Evanston; Kristen Leanne Lake, Winnetka, both of IL (US); Charles J. Peters, Weston, MA (US)

(73) Assignee: American Tool Companies, Inc., Hoffman Estates, IL (US)

( * ) Notice: Subject to any disclaimer, the term of this patent is extended or adjusted under 35 U.S.C. 154(b) by 0 days.

(21) Appl. No.: 09/361,379

(22) Filed: Jul. 27, 1999

(51) Int. Cl.[7] ..... A47F 1/04

(52) U.S. Cl. ..... 211/59.2; 211/113

(58) Field of Search ..... 211/59.2, 59.1, 211/59.4, 113, 119, 85.18, 85.26, 85.29, 85.31, 49.1, 106, 126.9, 133.2, 181.1; 248/146, 153, 175, 311.2, 313, 315, 156, 907

(56) References Cited

U.S. PATENT DOCUMENTS

| | | | | | |
|---|---|---|---|---|---|
| 772,558 | A | | 10/1904 | Duff | |
| 2,119,700 | A | * | 6/1938 | Burgess | 211/59.2 |
| D161,477 | S | | 1/1951 | Lieber et al. | |
| 2,692,053 | A | | 10/1954 | Calhoun et al. | |
| 2,744,634 | A | | 5/1956 | Conley, Jr. | |
| 2,868,385 | A | | 1/1959 | Dreyfus, Jr. | |
| 2,961,787 | A | | 11/1960 | Kies | |
| 2,969,988 | A | * | 1/1961 | Berlin | 211/181.1 |
| 3,152,697 | A | * | 10/1964 | Berman et al. | 211/59.2 |
| 3,153,526 | A | | 10/1964 | Pawsey | |
| 3,203,553 | A | | 8/1965 | Pendergrast, Jr. et al. | |
| 3,265,246 | A | | 8/1966 | Messenger | |
| 3,306,688 | A | | 2/1967 | Di Domenico | |
| 3,371,795 | A | * | 3/1968 | Rosonke | 211/59.2 |
| 3,404,927 | A | | 10/1968 | Mellion | |
| 3,484,069 | A | | 12/1969 | Larson | |
| 3,662,898 | A | | 5/1972 | Baxendale | |
| 3,967,346 | A | | 7/1976 | Young, Jr. | |
| 4,015,885 | A | | 4/1977 | Baggaley | |
| 4,027,799 | A | | 6/1977 | Stucker | |
| 4,067,444 | A | * | 1/1978 | Wilson | 211/126.9 |
| 4,069,997 | A | * | 1/1978 | Weiss | 248/313 |
| 4,343,405 | A | | 8/1982 | Virte et al. | |
| 4,742,923 | A | | 5/1988 | Calvert | |
| 4,776,470 | A | | 10/1988 | Chap | |
| 5,020,677 | A | * | 6/1991 | Wirth et al. | 211/113 |
| 5,386,916 | A | * | 2/1995 | Valiulis | 211/113 |
| 5,388,709 | A | | 2/1995 | Adams | |
| 5,626,318 | A | | 5/1997 | Boettger et al. | |
| 5,842,581 | A | | 12/1998 | Graefe | |
| 5,957,325 | A | * | 9/1999 | Montanez | 312/42 |
| 6,006,929 | A | | 12/1999 | Leonard | |
| 6,234,330 | B1 | | 5/2001 | Gray | |

* cited by examiner

*Primary Examiner*—Jerry Redman
*Assistant Examiner*—Jennifer E. Novosad
(74) *Attorney, Agent, or Firm*—Brinks Hofer Gilson & Gilson

(57) ABSTRACT

A rack for displaying and dispensing a plurality of products and accessory products which has an elgongated body having a top end and a bottom end, wherein the body defines at least one vertically oriented interior chute. The chute is adapted to hold the plurality of vertically stacked products. A signage panel is mounted on at least a portion of the body, and an accessory display support is attached to the body. An elongated accessory product display is attached to the accessory display support to display a plurality of accessory product adjacent the body.

14 Claims, 4 Drawing Sheets

PRODUCT DISPLAY AND DISPENSING RACK

BACKGROUND OF THE INVENTION

The present invention relates to a product display. In particular, the present invention relates to a display and dispensing rack for stacked products incorporating side-mounted accessory display apparatus.

The sale of consumable hardware products to consumers often requires a large number of the products to be available on the shelf at one time for purchase. This allows the consumer to readily obtain the products without having to wait for the retailer to re-stock the shelves with the products as they are sold. By keeping the shelf products available, the consumer may be adequately reminded to purchase the product with minimum overhead cost to the retailer.

Often, point-of-purchase displays are used to display products in retail areas having limited shelf space. For example, such displays may be used to dispense and display magazines, candies or pegboard items to consumers adjacent limited-space cash register lines. Because retail space in these areas is at a premium, the ability to keep these areas stacked with products in an efficient fashion is important for the sales success of the product.

The organization and efficient display of consumer products are greatly affected by the shape of the product container. For example, products such as caulk, sealant or powdered marking chalk often come in many varieties and colors. These products are typically sold in elongated cylindrically shaped containers. However, the product containers are not often displayed on a shelf in the horizontal position because the product will easily roll off the shelf. In the vertical position, the containers are highly unstable, and the labels on the containers are not easily visible.

Specialized display crates or boxes are sometimes used to hold these items, but it may be difficult to display necessary accessory items sufficiently close to the product display. For example, caulking tools and caulking guns may not be able to be displayed sufficiently close to the caulk containers so that a consumer may not be reminded to purchase these associated accessories along with the product. Similarly, various chalk marking tools and reels might not be displayed sufficiently close to the chalk container or vice versa, in order to encourage the consumer to purchase both items.

SUMMARY OF THE INVENTION

In order to alleviate the above shortcomings and in accordance with one aspect of the present invention, an improved product display and dispensing rack is provided which allows for the merchandising of a plurality of products and accessories to these products. In particular, a rack is provided that includes an elongated body having a top end and a bottom end. The body defines at least one vertically oriented interior chute that is adapted to hold a plurality of vertically stacked products. A generally flat signage panel is mounted on at least one outside portion of the body, and an accessory display support means is also attached to the body to support an elongated accessory product display along an outside of the body.

In another aspect of the present invention, a merchandise rack for displaying and dispensing a plurality of products is provided, which includes an elongated body defining at least one vertically oriented interior chute. The chute includes a top end and a bottom end and is adapted to hold a plurality of vertically stacked products. A retrieval tray is mounted adjacent the bottom end of the chute for receiving the stacked products for simplified removal from the display by the purchaser. In order to display accessory products to the stacked products, at least one elongated accessory product display strip extends vertically along an outside of the chute.

The accessory product display strip may include a plurality of hooks to display various packaged or unpackaged products. The strip is removable from the rack and may be pivotable relative thereto.

In yet another aspect of the present invention, a merchandise display rack for displaying and dispensing a plurality of cylindrically shaped first products and a plurality of packaged second products is provided. The rack includes an elongated body having a generally rectangular shape and a top end and a bottom end. The body defines a first vertically oriented interior chute and a second vertically oriented interior chute generally parallel to the first chute. The chutes each have a top end and a bottom end and are configured to hold the plurality of the first products. The first products may be arranged in a first stack within the first chute and a second stack within the second chute. A first retrieval tray is mounted adjacent a bottom end of the body to receive the first products emptying from the first chute and to guide the products forward of the first chute to facilitate removal from the display. The products are urged toward a front of the tray by the weight of the first stack of products in the chute. A similar tray structure is mounted below the bottom end of the body and generally parallel to the first retrieval tray for receiving and urging products from the second chute. At least a first eyelet is mounted near the top end of the body and a second eyelet is mounted near the bottom end of the body. A strip including a plurality of the second products is mounted to through the eyelets and is pivotable along an axis extending through the eyelets.

It is to be understood that both the foregoing general description and the following detailed description are exemplary and explanatory and are intended to provide further explanation of the invention as claimed.

The invention, together with further objects and attendant advantages, will best be understood by reference to the following detailed description, taken in conjunction with the accompanying drawings.

DETAILED DESCRIPTION OF THE PREFERRED EMBODIMENT

Figure 1:
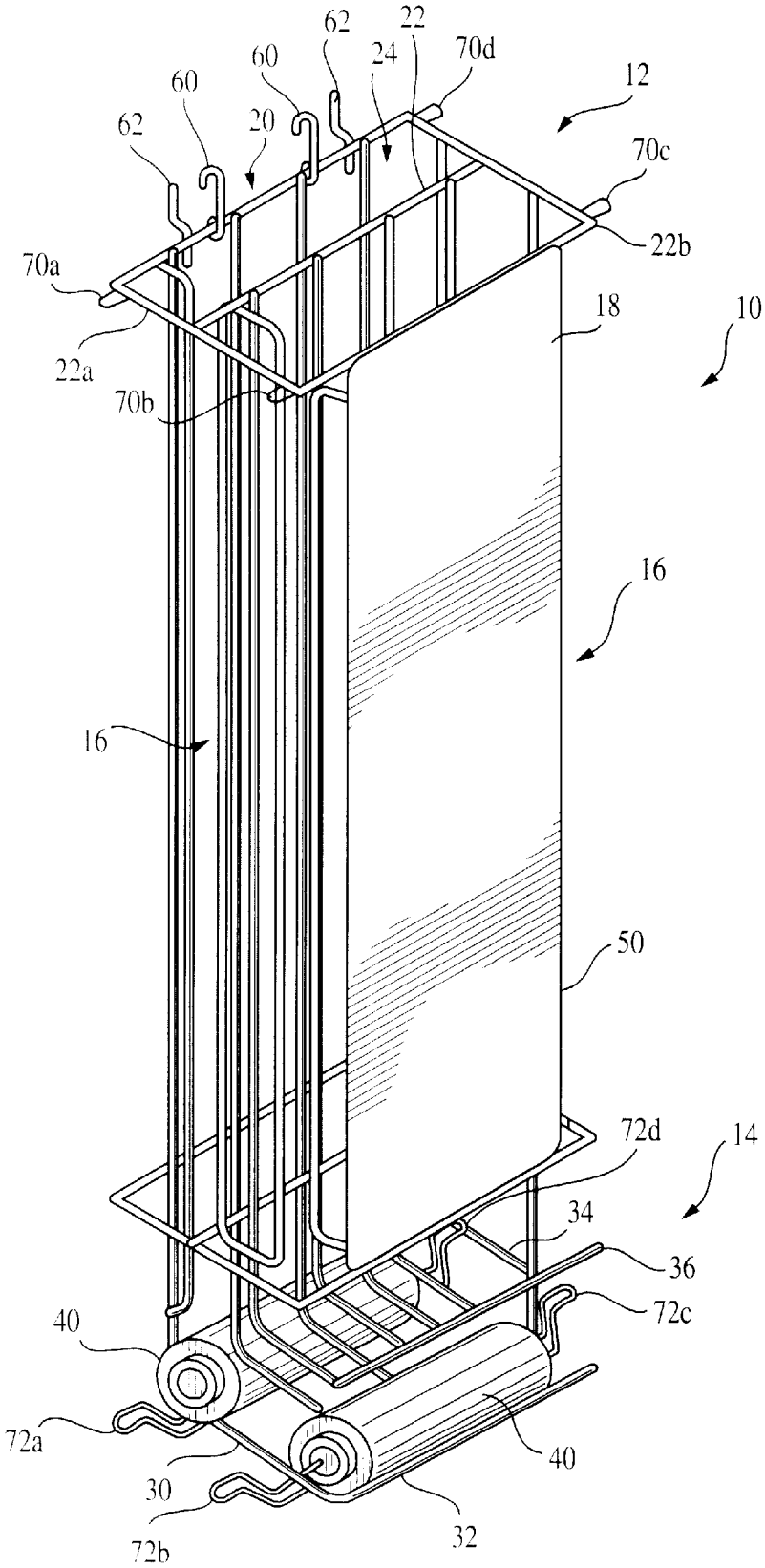
FIG. 1 is a perspective drawing of one preferred embodiment of the present invention.

Turning now to FIG. 1, a display and dispensing rack 10 is provided as shown in the perspective drawing of the Figure. The rack 10 is preferably constructed of 8-gauge coated steel wire welded at points of contact throughout the structure. Other suitable materials include plastic rods, panels, or other materials to provide sufficiently equivalent construction. The rack 10 includes a top end 12 and a bottom end 14. Side walls 16, front wall 18 and rear wall 20 are defined between the top end 12 and the bottom end 14 of the rack 10, defining an elongated, vertical tubular shape having a roughly rectangular cross-section.

A dividing wall 22 extends generally parallel to the rear wall 20 to divide the interior of the rack body 11 into a first chute 24 and a second chute 26 running the length of body 11. The chutes are preferably open at the top end 12 of the body 11, forming loading portions 22*a* and 22*b* on the chutes.

Affixed to the body 11 and extending generally transversely to the first chute 24 is a retrieval tray 30 having a retaining lip 32. The retrieval tray 30 receives items from the chute 24 and advances them forward toward the lip 32. To facilitate this, the tray 30 extends slightly downwardly toward the lip 32. Preferably, a second retrieval tray 34 extends parallel to the first tray 30 and is open to the second chute 26. A lip 36 is formed in the end of the tray 34 to retain products received from the chute 26.

Figure 3:
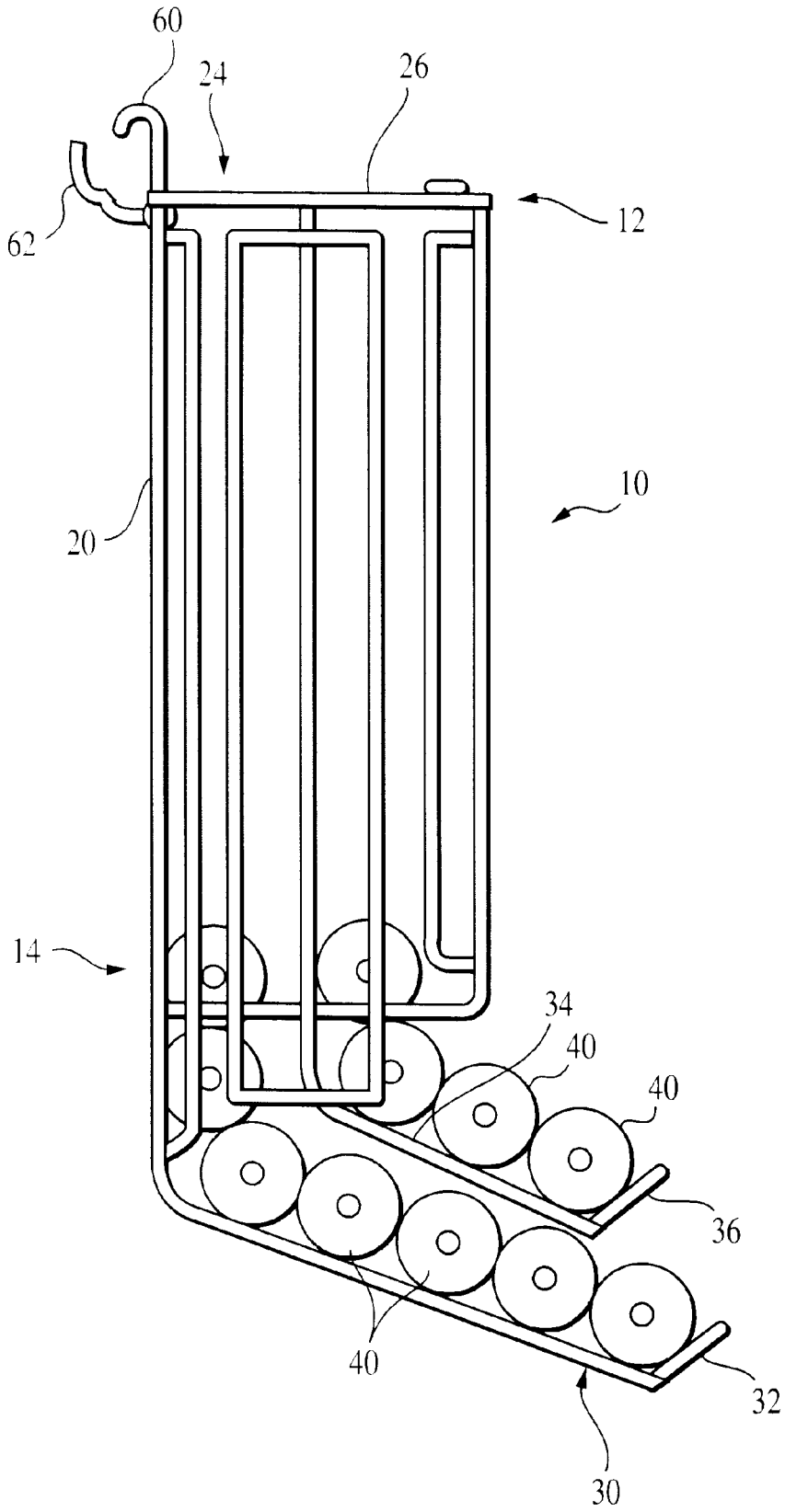
FIG. 3 is a side view of the embodiment shown in FIGS. 1 and 2.

Preferably, the structure of rack 10 and the receiving trays 30 and 34 are sized and shaped to receive elongated cylindrical containers 40 as shown in FIGS. 1 and 3. The containers 40 may be stacked within the chutes 24 and 26 via the loading area 22*a* and 22 *b* in the top end 12 of the rack 10. The weight of the containers 40 within the chutes 24 and 26 pushes the stack of containers 40 onto the transversely extending first and second trays 30 and 34. The products 40 are further urged by gravity and by the weight of the stack within the chutes toward the front of the trays and lips 32 and 36. The upstanding lips 32 and 36 prevent the containers 40 from falling out of the tray. When one of the cylindrical containers 40 is removed from one of the trays 30 or 34, a succeeding product container 40 is advanced against the lip 32 or 36 of the tray 30 or 34 to allow the consumer access to a successive container 40.

Preferably, the front of the display includes a flat signage panel 50 for advertising or labeling the contents of the display. The signage panel 50 is located on the front wall 18 of the rack body 11.

As further shown in FIG. 3, the top portion of the rear wall 20 of the rack 10 includes a plurality of mounting means for attaching the rack onto various supporting structures. Preferably, a pair of downwardly directed hooks 60 is welded to the rack 10 to allow the display to be hooked over a support means, display panel or divider rack. In the alternative, pegboard mounting fingers 62 may also be provided for insertion into keyboard holes (not shown) to support the rack 10 securely on a pegboard panel. Either one or both of hooks 60 and pegboard mounting means 62 may be present.

Figure 4:
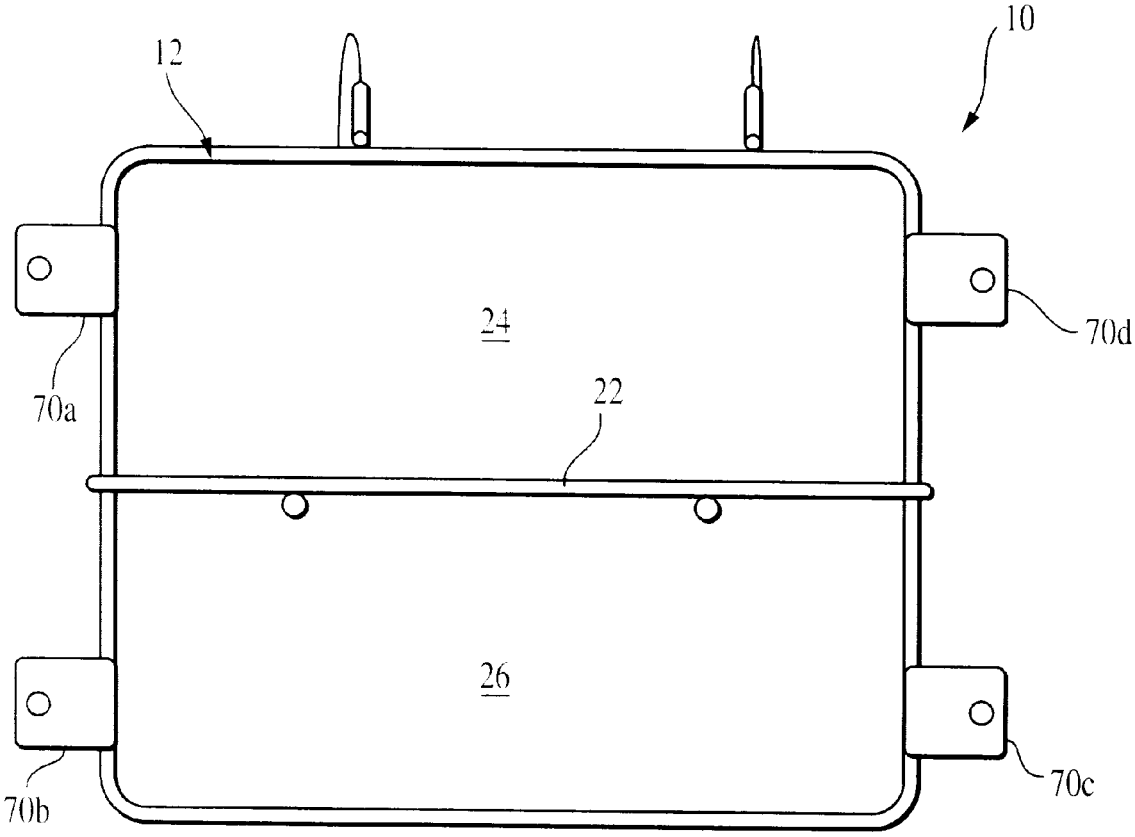
FIG. 4 is a top view of the embodiment shown in FIGS. 1–3.

In accordance with the present invention, a plurality of flanges or eyelets has been provided on the rack 10 to facilitate the display of accessory items to the cylindrical products 40. Preferably, as shown in FIGS. 1 and 4, flat flanges or eyelets 70*a–d* extend outwardly from the top end 12 of the rack body 11. Each of the flanges 70*a–d* defines a hole through the flange. Similarly, flanges or eyelets 72*a–d* also extend from the bottom end 14 of the rack 10, or more particularly from one of the trays 30 or 34 as shown. Preferably, the flanges or eyelets define holes, which are slightly offset vertically with the holes in flanges 70*a–d,* respectively.

Figure 2:
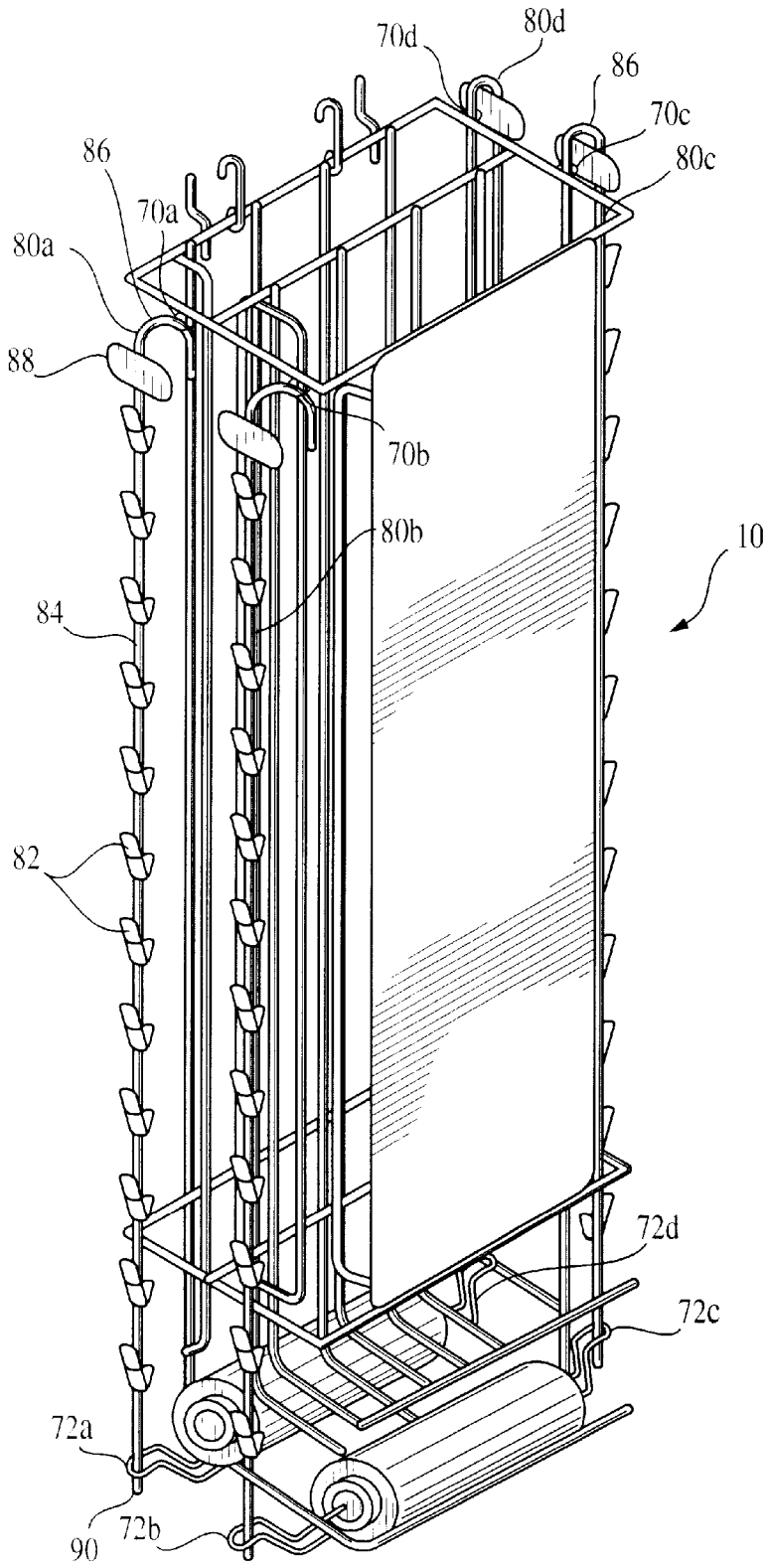
FIG. 2 is a perspective drawing of the embodiment of FIG. 1, including a plurality of mounted accessory display strips in accordance with the present invention.

As shown in FIG. 2, a plurality of accessory display strips 80*a–d* may be mounted to these flanges or eyelets 70*a–d* and 72*a–d*. Each of the display strips 80*a–d* includes a plurality of accessory mounting means 82 extending along an elongated wire 84. Means 82 may comprise spring-loaded clips, hooks, tags, or other structures suitable for holding various packages for accessory items. Each strip 80*a–d* preferably includes a top end defining a hook-shaped portion 86, as shown in conjunction with strip 80*a* in FIG. 2. Also, each strip preferably includes a labeling plate 88 for displaying inventory information for the accessory products displayed on the strip 80. The opposing ends 90 on the strip 80*a–d* are preferably straight. To mount one of the strips 80*a–d* to the rack 10, the hook end of the strip 86 is inserted into one of the flanges or eyelets 70*a–d,* and the opposing end 90 of one of the strips is inserted through a corresponding eyelet or flange 72*a–d.*

When mounted in this fashion, one or more of the strips 80*a–d* may pivot slightly within the flanges 70*a–d* and 72*a–d.* The strips may be purchased from the manufacturer already loaded with accessory products. Replacing the strips 80 on the display is simplified by simply lifting the empty strips from the eyelets or flanges 70*a–d* and 72*a–d* and inserting a new strip in its place.

This improved display rack allows the retailer to sell bulk container merchandise such as containers 40 stored in the interior of the rack body 11. Conveniently, other associated accessory products may be displayed and sold on one or more of the strips 80*a–d* adjacent the body 11. This type of display may allow more of an association between the two products to facilitate sales of both to consumers.

Of course, it should be understood that a wide range of changes and modifications can be made to the embodiments described above. For example, any or all portions of the preferred embodiment may be implemented in software as well as with hardware. It is therefore intended that the foregoing detailed description be regarded as illustrative rather than limiting and that it be understood that it is the following claims, including all equivalents, which are intended to define the scope of this invention.

What is claimed is:

1. A rack for displaying and dispensing a plurality of products and accessory products, said rack comprising:

an elongated body having a top end and a bottom end, said body defining at least one vertically oriented interior chute, said at least one chute adapted to hold a plurality of vertically stacked products;

a signage panel mounted on at least one outside portion of said body;

an accessory display support means attached to said body;

an elongated accessory product display removably attached to and separable from said support means, said accessory product display including a wire that has a plurality of hooks mounted along said wire, said product display capable of retaining a plurality of accessory products.

2. The rack of claim 1 wherein said body further comprises a bent wire frame.

3. The rack of claim 1 wherein said wire is bent at one end into a hook shape and said support means further comprises at least one eyelet extending from said body, said wire of said accessory product display being inserted through said at least one eyelet.

4. The rack of claim 3 further comprising a retrieval tray mounted adjacent said bottom end of said at least one chute for receiving some of said stacked products, said tray including a retaining lip for retaining one or more of said products in said tray.

5. The rack of claim 4 wherein said tray extends away from said at least one chute at an angle.

6. The rack of claim 5 further comprising a plurality of pegboard mounting fingers and plurality of mounting hooks attached to said top end of said body for securing said body to a support structure.

7. The rack of claim 6 wherein said top end defines a loading opening for receiving said vertically stacked products into said at least one chute.

8. A merchandise rack for displaying and dispensing a plurality of products, said rack comprising:

an elongated body defining at least one vertically oriented interior chute, said at least one chute having a top end and a bottom end, said at least one chute adapted to hold a plurality of vertically stacked products;

a signage panel mounted on an outside portion of said body;

a retrieval tray mounted adjacent said bottom end of said at least one chute for receiving said stacked products, said tray including a retaining lip for retaining one or more of said products in said tray; and at least one elongated accessory product display strip extending vertically along an outer side of said at least one chute, said display strip being removable and separable from said rack and including a plurality of package display mounts attached along said display strip adapted to support a plurality of accessory products.

9. The merchandise rack of claim 8 further comprising a flange extending from said body, said flange defining at least one opening for receiving and supporting a portion of said accessory product display strip.

10. The merchandise rack of claim 9, wherein said accessory product display strip further comprises a length of wire, and wherein at least one end of said wire is formed into a hook, said hook being inserted into said at least one opening in said flange to support said at least one display strip away from said body.

11. The merchandise rack of claim 9 wherein said accessory product display strip is pivotable relative to said body.

12. The merchandise rack of claim 8 wherein said tray extends generally transversely to said at least one chute.

13. The merchandise rack of claim 8 further comprising a plurality of pegboard mounting fingers and a plurality of mounting hooks attached to said top end of said body for securing said body to a support structure.

14. In combination, a merchandise display rack and a plurality of cylindrically shaped first merchandise products and a plurality of packaged second merchandise products, said rack comprising:

an elongated body having a generally rectangular shape and a top end and a bottom end, said body defining a first vertically oriented interior chute and a second vertically oriented interior chute generally parallel to said first chute, said chutes each having a top end and a bottom end and configured to hold said plurality of said first merchandise products oriented in a stack;

a plurality of said first merchandise products arranged in a first stack within said first chute and a plurality of said first merchandise products arranged in a second stack within said second chute;

a first retrieval tray mounted adjacent the bottom end of said body to receive said first merchandise products emptying from said first chute and which guides said first merchandise products forward of said first chute, said first merchandise products being urged toward a front of said tray by the weight of said first stack of merchandise products in said first chute;

a second retrieval tray mounted below said bottom end of said body and generally parallel to said first retrieval tray, said second retrieval tray oriented to receive said first merchandise products emptying from said second chute and which guides said first merchandise products forward of said second chute, said first merchandise products being urged toward a front of said tray by the weight of said second stack of merchandise products in said second chute;

a first eyelet mounted near said top end of said body and a second eyelet mounted near said bottom end of said body, said eyelets extending away from said body;

a strip having a plurality of said second merchandise products attached to said strip, a top end of said strip extending through said first eyelet and a bottom end of said strip extending through said second eyelet, said strip being pivotable along an axis extending through said eyelets.

* * * * *